US012571382B2

(12) United States Patent
Takeda et al.

(10) Patent No.: US 12,571,382 B2
(45) Date of Patent: Mar. 10, 2026

(54) TURBOMOLECULAR PUMP

(71) Applicant: Edwards Japan Limited, Yachiyo (JP)

(72) Inventors: Masayuki Takeda, Yachiyo (JP); Hiroshi Kaneta, Yachiyo (JP); Yukari Mizuno, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 162 days.

(21) Appl. No.: 18/551,334

(22) PCT Filed: Apr. 8, 2022

(86) PCT No.: PCT/JP2022/017350
§ 371 (c)(1),
(2) Date: Apr. 18, 2024

(87) PCT Pub. No.: WO2022/220197
PCT Pub. Date: Oct. 20, 2022

(65) Prior Publication Data

US 2024/0254980 A1 Aug. 1, 2024

(30) Foreign Application Priority Data

Apr. 15, 2021 (JP) ..... 2021-069220

(51) Int. Cl.
*F04B 37/02* (2006.01)
*F04D 19/04* (2006.01)

(52) U.S. Cl.
CPC ..... *F04B 37/02* (2013.01); *F04D 19/042* (2013.01)

(58) Field of Classification Search
CPC ..... F04D 19/042; F04D 19/045; F04B 37/14; F04B 37/04; F04B 37/02; F04B 37/06
See application file for complete search history.

(56) References Cited

U.S. PATENT DOCUMENTS 5,369,247 A * 11/1994 Doljack ..... H05B 3/14 219/505
6,416,290 B1 7/2002 Yamauchi
2004/0081560 A1* 4/2004 Blumenthal ..... F04D 27/00 417/423.4

(Continued)

FOREIGN PATENT DOCUMENTS

DE 10107341 A1 * 8/2002 ..... F04D 19/04
EP 3462034 A1 * 4/2019 ..... F04D 19/04

(Continued)

OTHER PUBLICATIONS

Office Action, and translation thereof, from counterpart Japanese Application No. 2021-069220 dated Nov. 14, 2024, 14 pp.

(Continued)

*Primary Examiner* — Thomas Fink
(74) *Attorney, Agent, or Firm* — Shumaker & Sieffert, P.A.

(57) ABSTRACT

A turbomolecular pump is obtained in which a gas absorbing substance is placed without increasing the axial length of an inlet port due to the gas absorbing substance. The turbomolecular pump includes a rotor portion and a stator portion in a casing (outer cylinder 127). The turbomolecular pump includes a getter pump portion, which is placed in the stator portion or the casing, and a heater portion 402, which performs at least one of activation and regeneration of a gas absorbing substance 401 of the getter pump portion.

5 Claims, 7 Drawing Sheets

(56) References Cited

U.S. PATENT DOCUMENTS

| | | | | |
|---|---|---|---|---|
| 2012/0128484 | A1* | 5/2012 | Hamochi | F04D 29/668 415/220 |
| 2019/0309408 | A1* | 10/2019 | Lauer | F04B 37/04 |
| 2022/0120282 | A1* | 4/2022 | Chew | F04B 37/02 |

FOREIGN PATENT DOCUMENTS

| | | | | | |
|---|---|---|---|---|---|
| JP | H02215977 | A | * | 8/1990 | |
| JP | H0932793 | A | | 2/1997 | |
| JP | 2002180988 | A | * | 6/2002 | F04D 29/584 |
| JP | 2002242877 | A | | 8/2002 | |
| JP | 2004278500 | A | | 10/2004 | |
| JP | 2008180168 | A | | 8/2008 | |
| JP | 2010025668 | A | | 2/2010 | |
| JP | 2018121269 | A | | 8/2018 | |
| WO | 9832972 | A1 | | 7/1998 | |

OTHER PUBLICATIONS

International Search Report and Written Opinion of International Application No. PCT/JP2022/017350, dated Jun. 7, 2022, 9 Pages.

* cited by examiner

TURBOMOLECULAR PUMP

This application is a U.S. national phase application under 35 U.S.C. § 371 of international application number PCT/JP2022/017350 filed on Apr. 8, 2022, which claims the benefit of JP application number 2021-069220 filed on Apr. 15, 2021. The entire contents of each of international application number PCT/JP2022/017350 and JP application number 2021-069220 are incorporated herein by reference.

TECHNICAL FIELD

The present disclosure relates to a turbomolecular pump.

BACKGROUND

A certain turbomolecular pump has a getter pump portion, and the getter pump portion includes a gas absorbing metal portion and a heater portion, which are in a hollow section in the inlet port and have the shape of a serpentine plate (see PTL 1, for example).

SUMMARY

However, in the turbomolecular pump described above, since the gas absorbing metal portion and the heater portion of the shape of a serpentine plate are installed in the hollow section of the inlet port, the axial length of the inlet port is increased. The increased length of the inlet port increases the axial length of the above turbomolecular pump. As such, it is difficult to adopt this structure when the installation space is limited.

In view of the foregoing issue, it is an object of the present disclosure to obtain a turbomolecular pump in which a gas absorbing substance is placed without increasing the axial length of the inlet port due to the gas absorbing substance.

A turbomolecular pump according to the present disclosure is a turbomolecular pump including a rotor portion and a stator portion in a casing, the turbomolecular pump including: a getter pump portion placed in the stator portion or the casing; and a heater portion configured to perform at least one of activation and regeneration of a gas absorbing substance of the getter pump portion.

According to the present disclosure, it is possible to obtain a turbomolecular pump in which a gas absorbing substance is placed without increasing the axial length of the inlet port due to the gas absorbing substance.

The above and other objects, features, and advantages of the present disclosure will become further apparent from the following detailed description together with the accompanying drawings.

DETAILED DESCRIPTION

Figure 1:
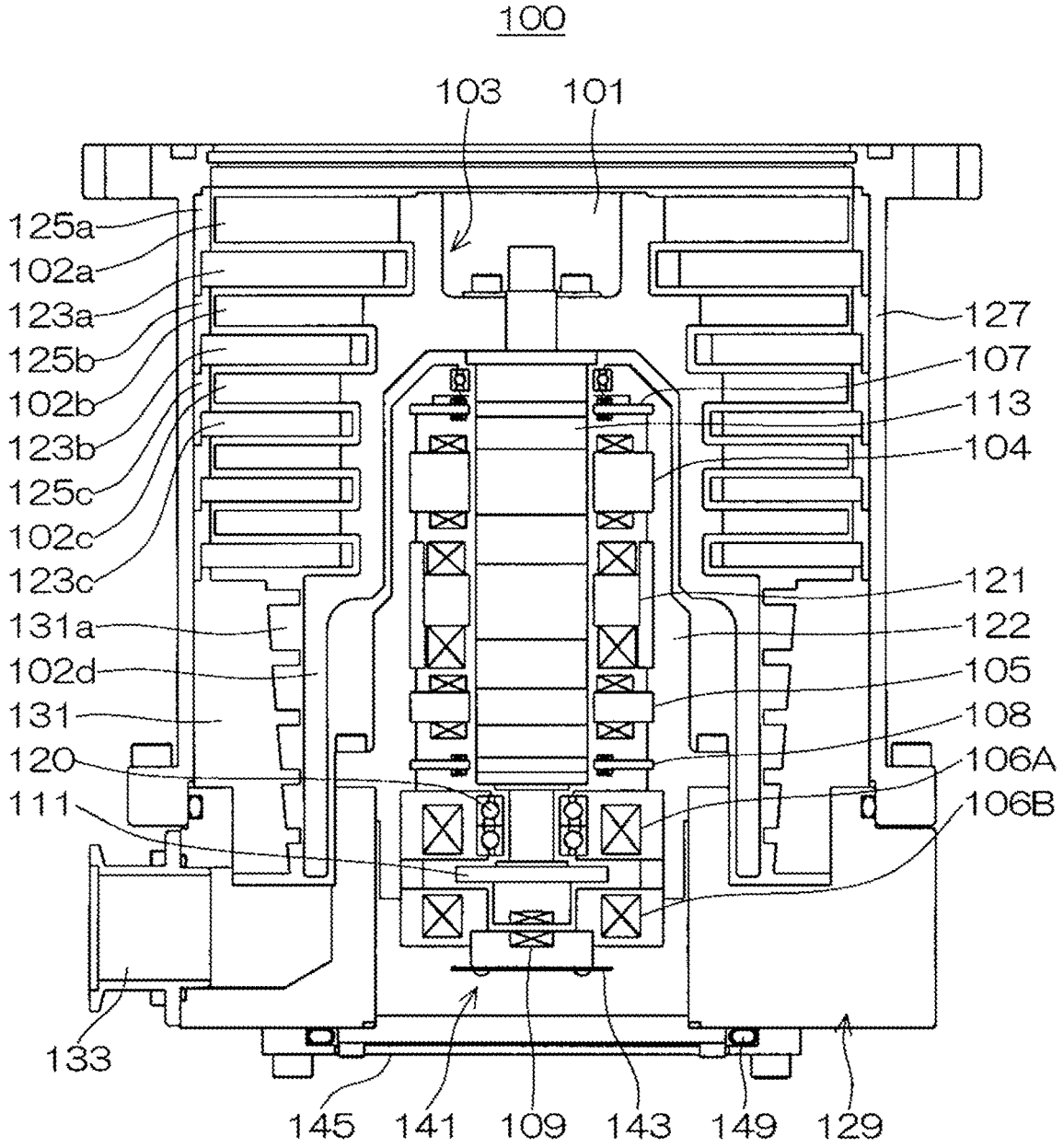
FIG. 1 is a longitudinal cross-sectional view showing a turbomolecular pump as a vacuum pump according to an example of the present disclosure.

Referring to the drawings, examples of the present disclosure are now described.

First Example

FIG. 1 is a longitudinal cross-sectional view of the turbomolecular pump 100. As shown in FIG. 1, the turbomolecular pump 100 has a circular outer cylinder 127 having an inlet port 101 at its upper end. Outer cylinder 127 may also be referred to as the casing. A rotating body 103 in the outer cylinder 127 includes a plurality of rotor blades 102 (102*a*, 102*b*, 102*c*, . . . ), which are turbine blades for gas suction and exhaustion, in its outer circumference section. The rotor blades 102 extend radially in multiple stages. The rotating body 103 has a rotor shaft 113 in its center. The rotor shaft 113 is supported and suspended in the air and position-controlled by a magnetic bearing of 5-axis control, for example. The rotating body 103 is typically made of a metal such as aluminum or an aluminum alloy.

Upper radial electromagnets 104 include four electromagnets arranged in pairs on an X-axis and a Y-axis. Four upper radial sensors 107 are provided in close proximity to the upper radial electromagnets 104 and associated with the respective upper radial electromagnets 104. Each upper radial sensor 107 may be an inductance sensor or an eddy current sensor having a conduction winding, for example, and detects a position of the rotor shaft 113 based on a change in the inductance of the conduction winding, which changes according to the position of the rotor shaft 113. The upper radial sensors 107 are configured to detect a radial displacement of the rotor shaft 113, that is, the rotating body 103 fixed to the rotor shaft 113, and send it to the controller 200.

In the controller 200, for example, a compensation circuit having a PID adjustment function generates an excitation control command signal for the upper radial electromagnets 104 based on a position signal detected by the upper radial sensors 107. Based on this excitation control command signal, an amplifier circuit 150 (described below) shown in FIG. 2 controls and excites the upper radial electromagnets 104 to adjust a radial position of an upper part of the rotor shaft 113.

The rotor shaft 113 may be made of a high magnetic permeability material (such as iron and stainless steel) and is configured to be attracted by magnetic forces of the upper radial electromagnets 104. The adjustment is performed independently in the X-axis direction and the Y-axis direction. Lower radial electromagnets 105 and lower radial sensors 108 are arranged in a similar manner as the upper radial electromagnets 104 and the upper radial sensors 107 to adjust the radial position of the lower part of the rotor shaft 113 in a similar manner as the radial position of the upper part.

Additionally, axial electromagnets 106A and 106B are arranged so as to vertically sandwich a metal disc 111, which has a shape of a circular disc and is provided in the lower part of the rotor shaft 113. The metal disc 111 is made of a high magnetic permeability material such as iron. An axial sensor 109 is provided to detect an axial displacement of the rotor shaft 113 and send an axial position signal to the controller 200.

In the controller 200, the compensation circuit having the PID adjustment function may generate an excitation control command signal for each of the axial electromagnets 106A and 106B based on the signal on the axial position detected by the axial sensor 109. Based on these excitation control command signals, the amplifier circuit 150 controls and excites the axial electromagnets 106A and 106B separately so that the axial electromagnet 106A magnetically attracts the metal disc 111 upward and the axial electromagnet 106B attracts the metal disc 111 downward. The axial position of the rotor shaft 113 is thus adjusted.

As described above, the controller 200 appropriately adjusts the magnetic forces exerted by the axial electromagnets 106A and 106B on the metal disc 111, magnetically levitates the rotor shaft 113 in the axial direction, and suspends the rotor shaft 113 in the air in a non-contact manner. The amplifier circuit 150, which controls and excites the upper radial electromagnets 104, the lower radial electromagnets 105, and the axial electromagnets 106A and 106B, is described below.

The motor 121 includes a plurality of magnetic poles circumferentially arranged to surround the rotor shaft 113. Each magnetic pole is controlled by the controller 200 so as to drive and rotate the rotor shaft 113 via an electromagnetic force acting between the magnetic pole and the rotor shaft 113. The motor 121 also includes a rotational speed sensor (not shown), such as a Hall element, a resolver, or an encoder, and the rotational speed of the rotor shaft 113 is detected based on a detection signal of the rotational speed sensor.

Furthermore, a phase sensor (not shown) is attached adjacent to the lower radial sensors 108 to detect the phase of rotation of the rotor shaft 113. The controller 200 detects the position of the magnetic poles using both detection signals of the phase sensor and the rotational speed sensor.

A plurality of stator blades 123 (123*a*, 123*b*, 123*c*, . . . ) are arranged slightly spaced apart from the rotor blades 102 (102*a*, 102*b*, 102*c*, . . . ). Each rotor blades 102 (102*a*, 102*b*, 102*c*, . . . ) is inclined by a predetermined angle from a plane perpendicular to the axis of the rotor shaft 113 in order to transfer exhaust gas molecules downward through collision. The stator blades 123 (123*a*, 123*b*, 123*c*, . . . ) are made of a metal such as aluminum, iron, stainless steel, copper, or a metal such as an alloy containing these metals as components.

The stator blades 123 are also inclined by a predetermined angle from a plane perpendicular to the axis of the rotor shaft 113. The stator blades 123 extend inward of the outer cylinder 127 and alternate with the stages of the rotor blades 102. The outer circumference ends of the stator blades 123 are inserted between and thus supported by a plurality of layered stator blade spacers 125 (125*a*, 125*b*, 125*c*, . . . ).

The stator blade spacers 125 are ring-shaped members made of a metal, such as aluminum, iron, stainless steel, or copper, or an alloy containing these metals as components, for example. The outer cylinder 127 is fixed to the outer circumferences of the stator blade spacers 125 with a slight gap. A base portion 129 is located at the base of the outer cylinder 127. The base portion 129 has an outlet port 133 providing communication to the outside. The exhaust gas transferred to the base portion 129 through the inlet port 101 from the chamber (vacuum chamber) is then sent to the outlet port 133.

According to the application of the turbomolecular pump 100, a threaded spacer 131 may be provided between the lower part of the stator blade spacer 125 and the base portion 129. The threaded spacer 131 is a cylindrical member made of a metal such as aluminum, copper, stainless steel, or iron, or an alloy containing these metals as components. The threaded spacer 131 has a plurality of helical thread grooves 131*a* engraved in its inner circumference surface. When exhaust gas molecules move in the rotation direction of the rotating body 103, these molecules are transferred toward the outlet port 133 in the direction of the helix of the thread grooves 131*a*. In the lowermost section of the rotating body 103 below the rotor blades 102 (102*a*, 102*b*, 102*c*, . . . ), a cylindrical portion 102*d* extends downward. The outer circumference surface of the cylindrical portion 102*d* is cylindrical and projects toward the inner circumference surface of the threaded spacer 131. The outer circumference surface is adjacent to but separated from the inner circumference surface of the threaded spacer 131 by a predetermined gap. The exhaust gas transferred to the thread groove 131*a* by the rotor blades 102 and the stator blades 123 is guided by the thread groove 131*a* to the base portion 129.

The base portion 129 is a disc-shaped member forming the base section of the turbomolecular pump 100, and is generally made of a metal such as iron, aluminum, or stainless steel. The base portion 129 physically holds the turbomolecular pump 100 and also serves as a heat conduction passage. As such, the base portion 129 is preferably made of rigid metal with high thermal conductivity, such as iron, aluminum, or copper.

In this configuration, when the motor 121 drives and rotates the rotor blades 102 together with the rotor shaft 113, the interaction between the rotor blades 102 and the stator blades 123 causes the suction of exhaust gas from the chamber through the inlet port 101. The rotational speed of the rotor blades 102 is usually 20000 rpm to 90000 rpm, and the circumferential speed at the tip of a rotor blades 102 reaches 200 m/s to 400 m/s. The exhaust gas taken through the inlet port 101 moves between the rotor blades 102 and the stator blades 123 and is transferred to the base portion 129. At this time, factors such as the friction heat generated when the exhaust gas comes into contact with the rotor blades 102 and the conduction of heat generated by the motor 121 increase the temperature of the rotor blades 102. This heat is conducted to the stator blades 123 through radiation or conduction via gas molecules of the exhaust gas, for example.

The stator blade spacers 125 are joined to each other at the outer circumference portion and conduct the heat received by the stator blades 123 from the rotor blades 102, the friction heat generated when the exhaust gas comes into contact with the stator blades 123, and the like to the outside.

In the above description, the threaded spacer 131 is provided at the outer circumference of the cylindrical portion 102*d* of the rotating body 103, and the thread grooves 131*a* are engraved in the inner circumference surface of the threaded spacer 131. However, conversely, thread grooves may be engraved in the outer circumference surface of the cylindrical portion 102*d*, while a spacer having a cylindrical inner circumference surface may be arranged around the outer circumference surface.

According to the application of the turbomolecular pump 100, to prevent the gas drawn through the inlet port 101 from entering an electrical portion, which includes the upper radial electromagnets 104, the upper radial sensors 107, the motor 121, the lower radial electromagnets 105, the lower radial sensors 108, the axial electromagnets 106A, 106B, and the axial sensor 109, the electrical portion may be surrounded by a stator column 122. The inside of the stator column 122 may be maintained at a predetermined pressure by purge gas.

In this case, the base portion 129 has a pipe (not shown) through which the purge gas is introduced. The introduced purge gas is sent to the outlet port 133 through gaps between a protective bearing 120 and the rotor shaft 113, between the rotor and the stator of the motor 121, and between the stator column 122 and the inner circumference cylindrical portion of the rotor blades 102.

The turbomolecular pump 100 may use the identification of the model and control based on individually adjusted unique parameters (for example, various characteristics associated with the model). To store these control parameters, the turbomolecular pump 100 includes an electronic circuit portion 141 in its main body. The electronic circuit portion 141 may include a semiconductor memory, such as an EEPROM, electronic components such as semiconductor elements for accessing the semiconductor memory, and a substrate 143 for mounting these components. The electronic circuit portion 141 is housed under a rotational speed sensor (not shown) near the center, for example, of the base portion 129, which forms the lower part of the turbomolecular pump 100, and is closed by an airtight bottom lid 145.

Some process gas introduced into the chamber in the manufacturing process of semiconductors has the property of becoming solid when its pressure becomes higher than a predetermined value or its temperature becomes lower than a predetermined value. In the turbomolecular pump 100, the pressure of the exhaust gas is lowest at the inlet port 101 and highest at the outlet port 133. When the pressure of the process gas increases beyond a predetermined value or its temperature decreases below a predetermined value while the process gas is being transferred from the inlet port 101 to the outlet port 133, the process gas is solidified and adheres and accumulates on the inner side of the turbomolecular pump 100.

For example, when SiCl4 is used as the process gas in an Al etching apparatus, according to the vapor pressure curve, a solid product (for example, AlCl3) is deposited at a low vacuum (760 [torr] to 10-2 [torr]) and a low temperature (about 20[° C.]) and adheres and accumulates on the inner side of the turbomolecular pump 100. When the deposits of the process gas accumulate in the turbomolecular pump 100, the accumulation may narrow the pump flow passage and degrade the performance of the turbomolecular pump 100. The above-mentioned product tends to solidify and adhere in areas with higher pressures, such as the vicinity of the outlet port 133 and the vicinity of the threaded spacer 131.

To solve this problem, conventionally, a heater or annular water-cooled tube 149 (not shown) is wound around the outer circumference of the base portion 129, and a temperature sensor (e.g., a thermistor, not shown) is embedded in the base portion 129, for example. The signal of this temperature sensor is used to perform control to maintain the temperature of the base portion 129 at a constant high temperature (set temperature) by heating with the heater or cooling with the water-cooled tube 149 (hereinafter referred to as TMS (temperature management system)).

Figure 2:
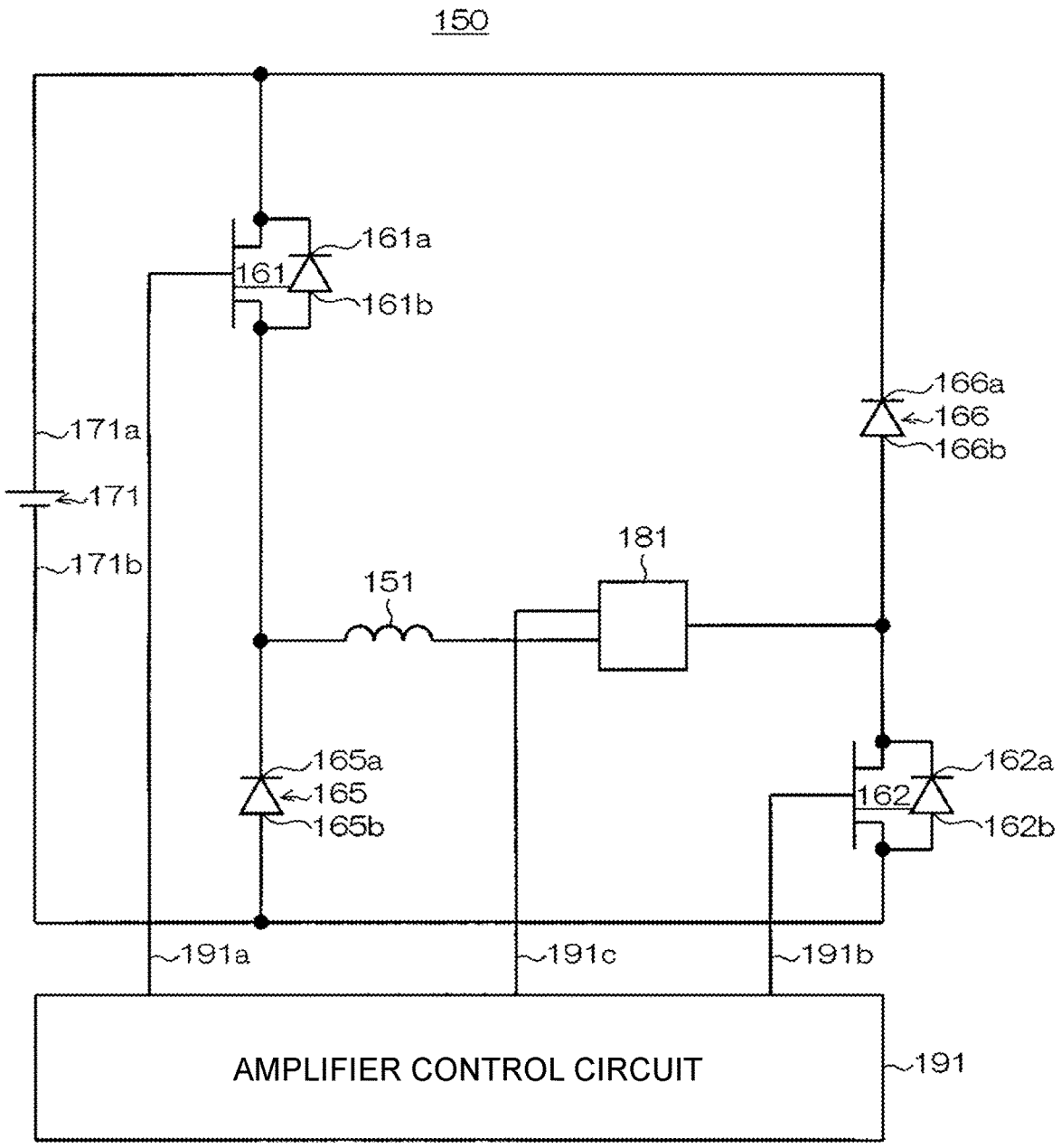
FIG. 2 is a circuit diagram showing an amplifier circuit for controlling and exciting electromagnets of the turbomolecular pump shown in FIG. 1.

The amplifier circuit 150 is now described that controls and excites the upper radial electromagnets 104, the lower radial electromagnets 105, and the axial electromagnets 106A and 106B of the turbomolecular pump 100 configured as described above. FIG. 2 is a circuit diagram of the amplifier circuit 150.

In FIG. 2, one end of an electromagnet winding 151 forming an upper radial electromagnet 104 or the like is connected to a positive electrode 171*a* of a power supply 171 via a transistor 161, and the other end is connected to a negative electrode 171*b* of the power supply 171 via a current detection circuit 181 and a transistor 162. Each transistor 161, 162 is a power MOSFET and has a structure in which a diode is connected between the source and the drain thereof.

In the transistor 161, a cathode terminal 161*a* of its diode is connected to the positive electrode 171*a*, and an anode terminal 161*b* is connected to one end of the electromagnet winding 151. In the transistor 162, a cathode terminal 162*a* of its diode is connected to a current detection circuit 181, and an anode terminal 162*b* is connected to the negative electrode 171*b*.

A diode 165 for current regeneration has a cathode terminal 165*a* connected to one end of the electromagnet winding 151 and an anode terminal 165*b* connected to the negative electrode 171*b*. Similarly, a diode 166 for current regeneration has a cathode terminal 166*a* connected to the positive electrode 171*a* and an anode terminal 166*b* connected to the other end of the electromagnet winding 151 via the current detection circuit 181. The current detection circuit 181 may include a Hall current sensor or an electric resistance element, for example.

The amplifier circuit 150 configured as described above corresponds to one electromagnet. Accordingly, when the magnetic bearing uses 5-axis control and has ten electromagnets 104, 105, 106A, and 106B in total, an identical amplifier circuit 150 is configured for each of the electromagnets. These ten amplifier circuits 150 are connected to the power supply 171 in parallel.

An amplifier control circuit 191 may be formed by a digital signal processor portion (not shown, hereinafter referred to as a DSP portion) of the controller 200. The amplifier control circuit 191 switches the transistors 161 and 162 between on and off.

The amplifier control circuit 191 is configured to compare a current value detected by the current detection circuit 181 (a signal reflecting this current value is referred to as a current detection signal 191*c*) with a predetermined current command value. The result of this comparison is used to determine the magnitude of the pulse width (pulse width time Tp1, Tp2) generated in a control cycle Ts, which is one cycle in PWM control. As a result, gate drive signals 191*a* and 191*b* having this pulse width are output from the amplifier control circuit 191 to gate terminals of the transistors 161 and 162.

Under certain circumstances such as when the rotational speed of the rotating body 103 reaches a resonance point during acceleration, or when a disturbance occurs during a constant speed operation, the rotating body 103 may use positional control at high speed and with a strong force. For this purpose, a high voltage of about 50 V, for example, is used for the power supply 171 to enable a rapid increase (or decrease) in the current flowing through the electromagnet winding 151. Additionally, a capacitor is generally connected between the positive electrode 171*a* and the negative electrode 171*b* of the power supply 171 to stabilize the power supply 171 (not shown).

In this configuration, when both transistors 161 and 162 are turned on, the current flowing through the electromagnet winding 151 (hereinafter referred to as an electromagnet current iL) increases, and when both are turned off, the electromagnet current iL decreases.

Also, when one of the transistors 161 and 162 is turned on and the other is turned off, a freewheeling current is maintained. Passing the freewheeling current through the amplifier circuit 150 in this manner reduces the hysteresis loss in the amplifier circuit 150, thereby limiting the power consumption of the entire circuit to a low level. Moreover, by controlling the transistors 161 and 162 as described above, high frequency noise, such as harmonics, generated in the turbomolecular pump 100 can be reduced. Furthermore, by measuring this freewheeling current with the current detection circuit 181, the electromagnet current iL flowing through the electromagnet winding 151 can be detected.

Figure 3:
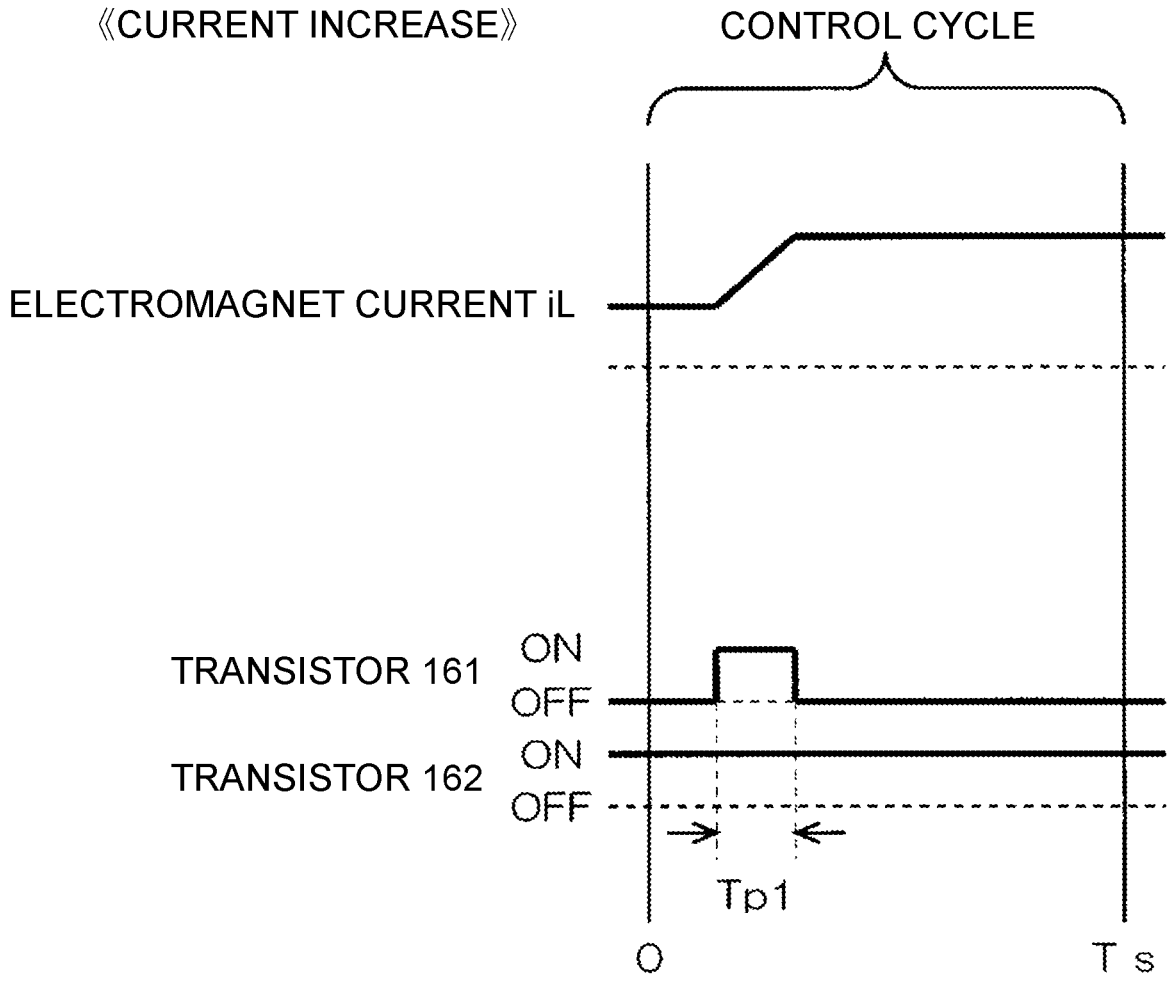
FIG. 3 is a time chart showing control performed when a current command value is greater than a detected value.

That is, when the detected current value is smaller than the current command value, as shown in FIG. 3, the transistors 161 and 162 are simultaneously on only once in the control cycle Ts (for example, 100 μs) for the time corresponding to pulse width time Tp1. During this time, the electromagnet current iL increases accordingly toward the current value iLmax (not shown) that can be passed from the positive electrode 171*a* to the negative electrode 171*b* via the transistors 161 and 162.

Figure 4:
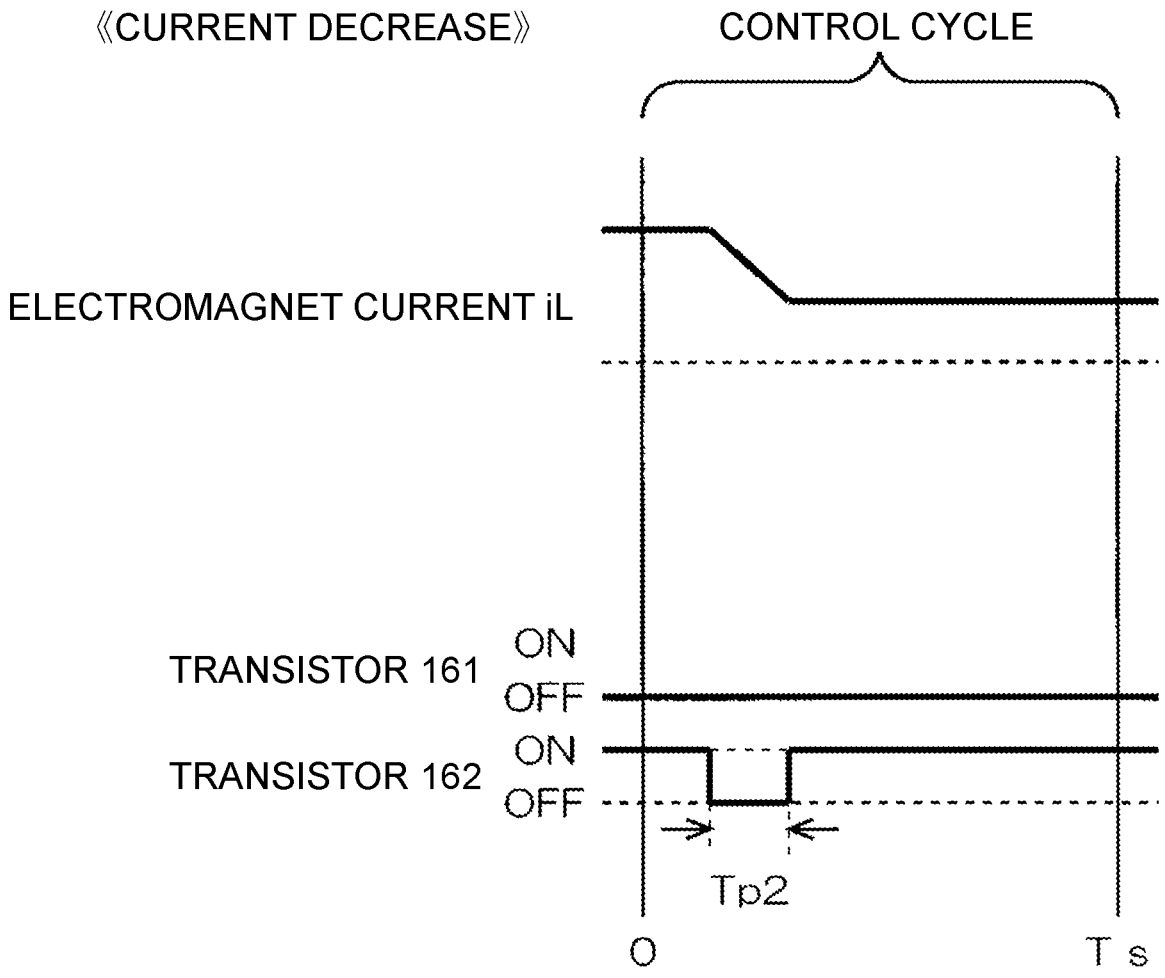
FIG. 4 is a time chart showing control performed when a current command value is less than a detected value.

When the detected current value is larger than the current command value, as shown in FIG. 4, the transistors 161 and 162 are simultaneously off only once in the control cycle Ts for the time corresponding to pulse width time Tp2. During this time, the electromagnet current iL decreases accordingly toward the current value iLmin (not shown) that can be regenerated from the negative electrode 171*b* to the positive electrode 171*a* via the diodes 165 and 166.

In either case, after pulse width time Tp1, Tp2 has elapsed, one of the transistors 161 and 162 is on. During this period, the freewheeling current is thus maintained in the amplifier circuit 150.

The turbomolecular pump 100 is configured as described above. Also, in FIG. 1, the rotor blades 102 and the rotating body 103 serve as a rotor portion of the turbomolecular pump 100, the stator blades 123 and the stator blade spacers 125 serve as a stator portion of the turbomolecular pump portion 100, and the threaded spacer 131 serves as a stator portion of a threaded spacer pump portion, which is subsequent to the turbomolecular pump portion. Additionally, the inlet port 101 and the outer cylinder 127 serve as a casing of the turbomolecular pump 100 and house the above-mentioned rotor portion and the above-mentioned multiple stator portions. The above-mentioned rotor portion is rotationally held in the above-mentioned casing, and the above-mentioned stator portions are placed to face the rotor portion.

Also, the turbomolecular pump 100 shown in FIG. 1 includes a getter pump portion, which is placed in the stator portion or the casing, and a heater portion, which performs at least one of activation and regeneration of a gas absorbing substance of the getter pump portion.

Figure 5:
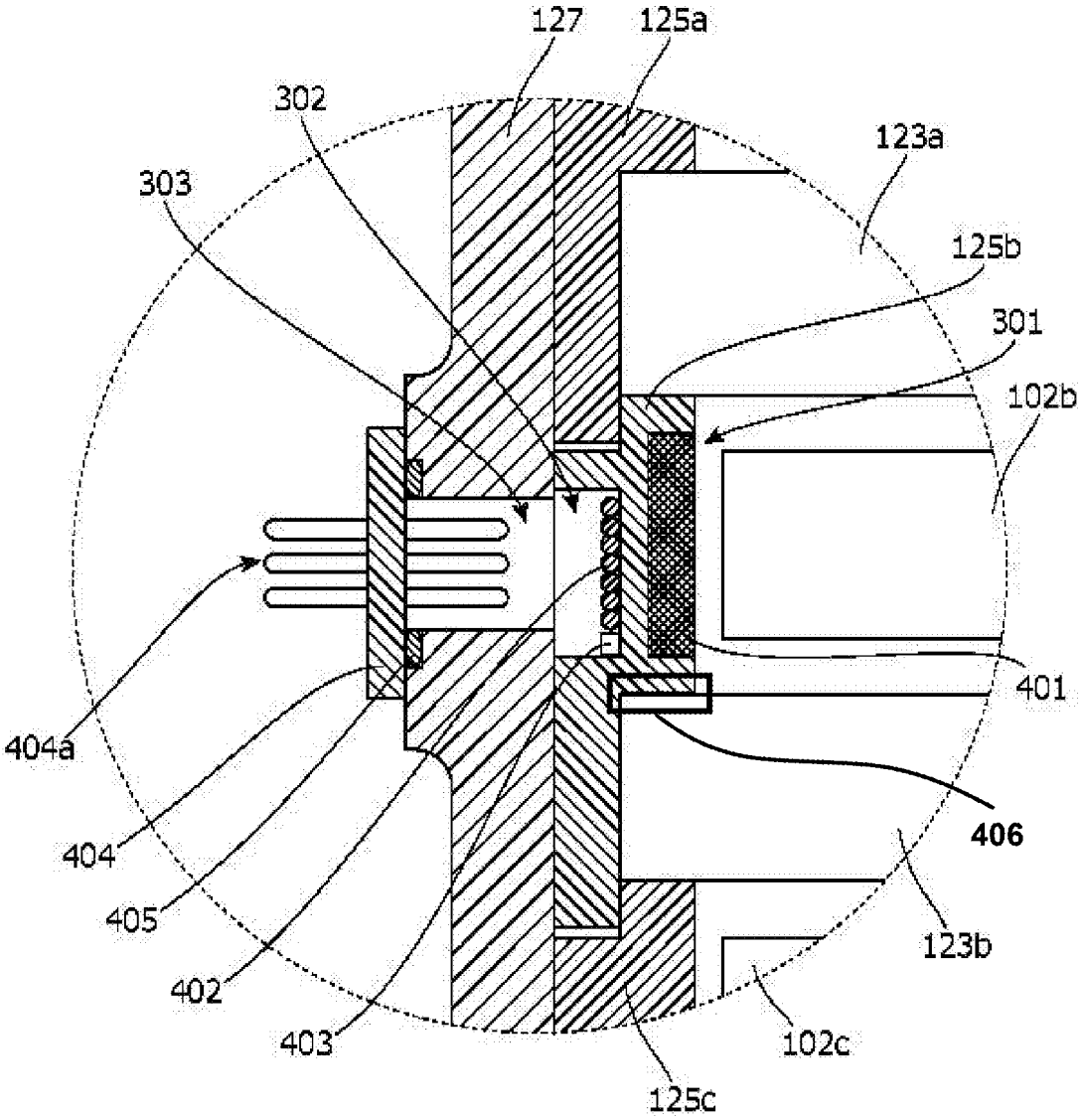
FIG. 5 is a cross-sectional view showing an example of a getter pump portion of a turbomolecular pump according to a first example.

FIG. 5 is a cross-sectional view showing an example of a getter pump portion of a turbomolecular pump according to the first example. In the first example, as shown in FIG. 5 for example, the getter pump portion is placed in the ring-shaped stator blade spacer 125*b* in the stator portion. Specifically, the getter pump portion includes an annular groove 301 that is formed in the circumferential direction in the inner circumference surface of the stator blade spacer 125*b*, and a gas absorbing substance 401 that is placed in this groove 301. The getter pump portion including a thermal resistance increasing means 406.

In the first example, the gas absorbing substance 401 is a gas absorbing substance for a non-evaporable getter pump (NEG pump) and may be in the form of pellets or powder. The gas absorbing substance 401 is made of a known NEG pump metal, such as titanium, zirconium, vanadium, iron, or an alloy of these metals. Also, to keep the gas absorbing substance 401 from falling into the hollow section of the stator blade spacer 125*b*, the gas absorbing substance 401 is fixed to the groove 301, or a mesh member is provided at the opening of the groove 301, for example.

As described above, the stator portion includes the stator blades 123 in multiple stages (the stator blade 123*a* in the first stage, the stator blade 123*b* in the second stage, the stator blade 123*c* in the third stage, . . . ) and the stator blade spacers 125 in multiple stages (125*a*, 125*b*, 125*c*, . . . ), which position the stator blades 123 in the multiple stages. In the first example, the above getter pump portion is placed in at least the stator blade in one stage of the stator blades 123 in multiple stages, or at least the stator blade spacer in one stage of the stator blade spacers 125 in multiple stages. The getter pump portion shown in FIG. 5 is placed in the stator blade spacer 125*b* in one stage, but multiple getter pump portions may be placed in stator blade spacers in multiple stages.

In the first example, the getter pump portion is placed closer to the outlet port 133 than the rotor blade 102*a* in the first stage (the rotor blade closest to the inlet port 101) of the rotor blades 102 in multiple stages. In this example, the getter pump portion is placed in the stator blade spacer 125*b* in the first stage as shown in FIG. 5 for example.

Also, in the first example, the above-mentioned heater portion 402 is placed in the stator blade spacer 125*b*. Specifically, as shown in FIG. 5 for example, an annular groove 302 is formed corresponding to the groove 301 in the outer circumference surface of the stator blade spacer 125*b*, and a resistance heating element as the heater portion 402 is wound around the wall surface of the groove 302 extending in the axial direction.

Furthermore, in the first example, a temperature sensor 403 for controlling the temperature of the gas absorbing substance 401 is placed adjacent to the heater portion 402 in the stator blade spacer 125*b*. The output signal of the temperature sensor 403 is output to the controller 200. The controller 200 controls the conducting current of the heater portion 402 on the basis of the output signal of the temperature sensor 403, thus performing temperature control of the gas absorbing substance 401 during activation and/or regeneration.

As for the temperature control of the gas absorbing substance 401 during activation and/or regeneration, instead of providing the temperature sensor 403, the controller 200 may monitor the conducting current of the heater portion 402 and perform constant resistance control based on the conducting current so as to perform temperature control of the gas absorbing substance 401.

Furthermore, the first example may include a thermal resistance increasing means 406 that increases the thermal resistance between a first member in which the getter pump portion is placed (that is, the stator blade spacer 125*b*) and a second member adjacent to the first member (that is, the stator blade 123*b*) as compared to an instance where they are in planar contact with each other. For example, the thermal resistance increasing means 406 may be a heat insulating member interposed between the opposed surfaces of the first and second members, a ring-shaped ridge formed on at least one of the opposed surfaces of the first and second members, or multiple ridges placed along the circumference.

The casing also includes an external connection portion, which electrically connects the heater portion 402 and an external circuit (not shown) (such as a drive circuit of the heater portion 402 controlled by the controller 200). As shown in FIG. 5 for example, this external connection portion includes a hole 303, which is formed in the casing (outer cylinder 127), and a feedthrough connector 404 and an O-ring 405, which seal the opening of the hole 303 at the outer circumference. The feedthrough connector 404 includes at least two terminals 404*a*.

The operation of the turbomolecular pump 100 according to the first example is now described.

(a) Operation During Pump Operation

When the turbomolecular pump 100 is in operation, the motor 121 operates to rotate the rotor portion under the control of the controller 200. As a result, the gas that has flowed in through the inlet port 101 is transferred along the gas flow passage between the rotor portion and the stator portions, and is discharged from the outlet port 133 to the external piping. Also, in the getter pump portion, gas molecules are absorbed on the surface of the gas absorbing substance 401. At this time, the controller 200 does not operate the heater portion 402.

In the turbomolecular pump portion (that is, the pump portion formed by the rotor portion and the stator portions described above) of the turbomolecular pump 100, the exhaust speed gradually decreases when the gas pressure becomes lower than the high vacuum range. In the getter pump portion (that is, the gas absorbing substance 401 described above) of the turbomolecular pump 100, the exhaust speed is substantially constant regardless of the gas pressure, enabling exhaust with a gas pressure lower than the high vacuum range.

In particular, the exhaust speed of the turbomolecular pump portion is low for light molecules such as hydrogen molecules, but the getter pump portion can sufficiently exhaust (absorb) such molecules. Thus, such gas molecules, which would remain if only the turbomolecular pump portion is present, are exhausted by the getter pump portion, limiting effects on the processes in the chamber on the upstream side of the turbomolecular pump 100.

(b) Operation During Activation or Regeneration

During activation or regeneration, the controller 200, while performing temperature control as described above, controls a drive circuit (not shown) to apply a current to the heater portion 402, increases the temperature of the gas absorbing substance 401 to a predetermined temperature, and maintains the temperature of the gas absorbing substance 401 at the predetermined temperature for a predetermined period so as to perform activation or regeneration of the gas absorbing substance 401. For example, the temperature of the gas absorbing substance 401 is increased to about 400 degrees Celsius during activation, and the temperature of the gas absorbing substance 401 is increased to about 200 degrees Celsius during regeneration. At this time, the controller 200 operates the motor 121 to rotate the rotor portion. This allows the gas emitted from the gas absorbing substance 401 during activation or regeneration to be easily discharged along the gas flow passage. Also, since the gas absorbing substance 401 is placed closer to the outlet port 133 than the rotor blade 102 (on the downstream side), the gas emitted from the gas absorbing substance 401 during activation or regeneration is unlikely to flow back.

As described above, in the first example, the turbomolecular pump 100 includes the getter pump portion in the stator portion or the casing of the turbomolecular pump 100, and also includes the heater portion 402, which performs at least one of activation and regeneration of the gas absorbing substance 401 of the getter pump portion.

As such, the gas absorbing substance 401 absorbs gas at the inner wall portion of a ring-shaped or cylindrical member facing the gas flow passage, to avoid an increase of the axial length of the inlet port 101 due to the gas absorbing substance 401. Additionally, since the getter pump portion and the heater portion are placed in a specific member (stator blade spacer 125*b* in the first example), the getter pump function can be easily added to an existing turbomolecular pump by replacing one member of the existing turbomolecular pump with the above member. Furthermore, since the sizes of the components of an existing turbomolecular pump are rarely changed, the addition of the getter pump function is less likely to be affected by limitation of the installation space of the turbomolecular pump.

Second Example

Figure 6:
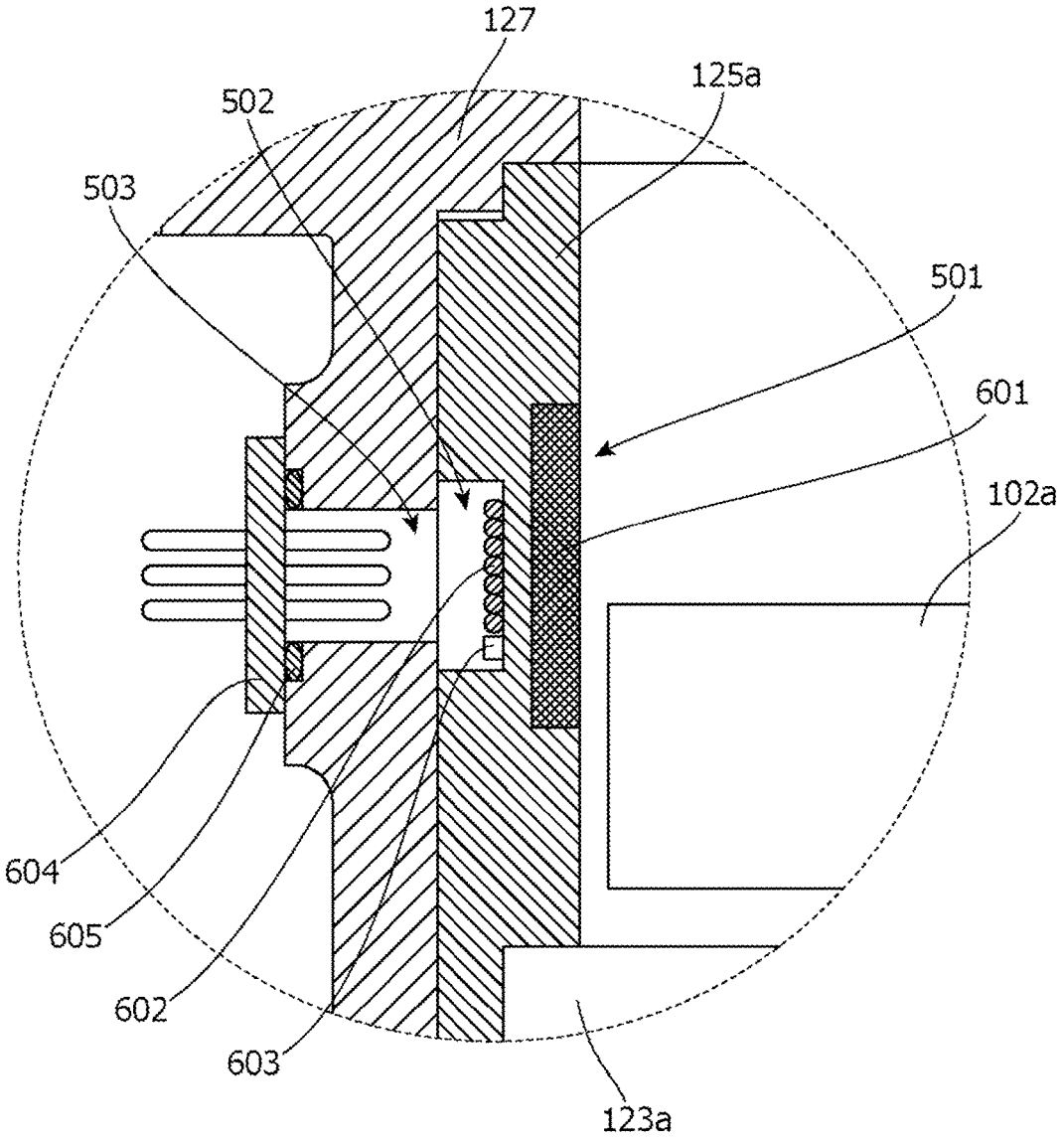
FIG. 6 is a cross-sectional view showing an example of a getter pump portion of a turbomolecular pump according to a second example.

FIG. 6 is a cross-sectional view showing an example of the getter pump portion in a turbomolecular pump 100 according to a second example. In the second example, as shown in FIG. 6 for example, a getter pump portion (gas absorbing substance 601) and a heater portion 602 are placed closer to the inlet port 101 than the stator blade 123*a* in the first stage in the axial direction. Specifically, an annular groove 501 is formed in the circumferential direction in the inner circumference surface of the stator blade spacer 125*a* in the foremost stage, and a gas absorbing substance 601, which is similar to the gas absorbing substance 401, is placed in this groove 501. Also, a heater portion 602 similar to the heater portion 402 is placed in the stator blade spacer 125*a*. Specifically, as shown in FIG. 6 for example, an annular groove 502 is formed corresponding to the groove 501 in the outer circumference surface of the stator blade spacer 125*a*, and a resistance heating element as the heater portion 602 is wound around the wall surface of the groove 502 extending in the axial direction. A temperature sensor 603 similar to the temperature sensor 403 is placed in the groove 502.

The casing also includes an external connection portion, which electrically connects the heater portion 602 and an external circuit (not shown) (such as a drive circuit of the heater portion 602 controlled by the controller 200). As shown in FIG. 6 for example, this external connection portion includes a hole 503, a feedthrough connector 604, and an O-ring 605 similar to the hole 303, the feedthrough connector 404, and the O-ring 405 described above.

Since the other configurations and operations of the turbomolecular pump 100 according to the second example are the same as those of the first example, the description thereof is omitted.

Third Example

Figure 7:
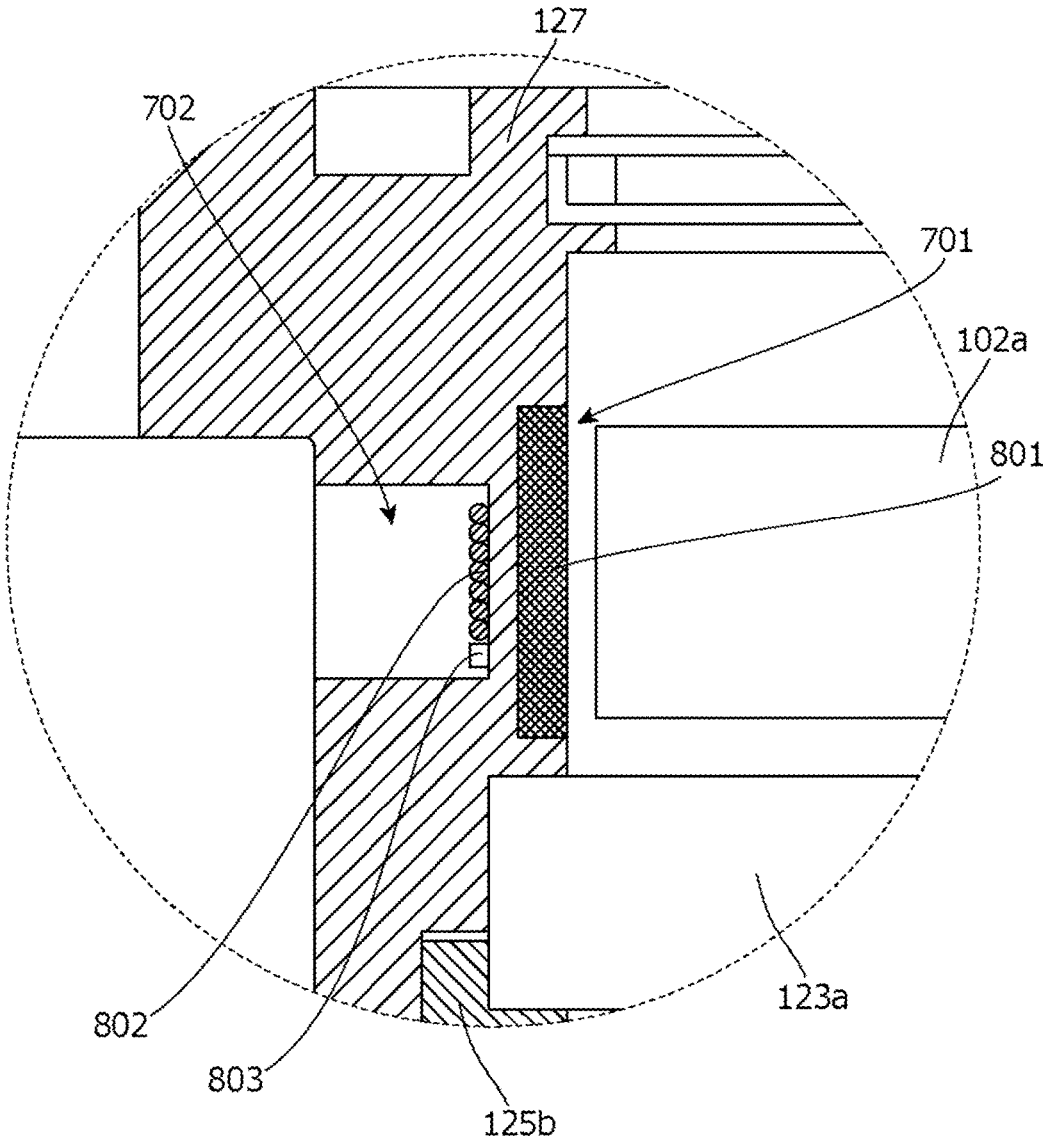
FIG. 7 is a cross-sectional view showing an example of a getter pump portion of a turbomolecular pump according to a third example.

FIG. 7 is a cross-sectional view showing an example of the getter pump portion in a turbomolecular pump according to a third example. In the third example, as shown in FIG. 7 for example, a getter pump portion (gas absorbing substance 801) and a heater portion 802 are placed in the casing (specifically, the outer cylinder 127) described above. Specifically, an annular groove 701 is formed in the circumferential direction in the inner circumference surface of the outer cylinder 127 facing the gas flow passage, and a gas absorbing substance 801, which is similar to the gas absorbing substance 401, 601, is placed in this groove 701. Also, a heater portion 802 similar to the heater portion 402, 602 is placed in the outer cylinder 127. Specifically, as shown in FIG. 7 for example, an annular groove 702 is formed corresponding to the groove 701 in the outer circumference surface of the outer cylinder 127, and a resistance heating element as the heater portion 802 is wound around the wall surface of the groove 702 extending in the axial direction. A temperature sensor 803 similar to the temperature sensor 403, 603 is placed in the groove 702.

Since the other configurations and operations of the turbomolecular pump 100 according to the third example are the same as those of the first and second examples, the description thereof is omitted.

Various alterations and modifications to the above-described examples will be apparent to those skilled in the art. Such alterations and modifications may be made without departing from the spirit and scope of the subject matter and without compromising the intended advantages. That is, such alterations and modifications are intended to be within the scope of the claims.

For example, in each of the first, second, and third examples, the heater portion 402, 602, 802 is placed in the member in which the getter pump portion (gas absorbing substance 401, 601, 801) is placed, but it may be placed in a member other than the member in which the getter pump portion is placed (member adjacent to the member in which the getter pump portion is placed).

Also, in each of the first, second, and third examples, the heater portion 402, 602, 802 may also function as a bakeout heater for releasing gas or the like remaining inside the pump during initial exhaust. This avoids the use of a separately install a bakeout heater, thereby reducing the cost.

Furthermore, in each of the first, second, and third examples, the stator blade spacer 125 in each stage described above may be formed by a single member, or may be formed by coupling multiple (e.g., two) members separated in the circumferential direction.

Furthermore, in each of the first, second, and third examples, the getter pump portion (gas absorbing substance 401, 601, 801) is placed at a position where the heat generated during pump operation will not increase the temperature of the getter pump portion to the temperature for regeneration of the gas absorbing substance.

Furthermore, in each of the first, second, and third examples, multiple recesses may be provided in place of the groove 301, 501, 701, and the gas absorbing substance 401, 601, 801 may be placed in these recesses in the same manner.

Furthermore, in the first and second examples, instead of the holes 303 and 503 in the outer cylinder 127, holes for other purposes (such as various ports including one for a vent valve) may be used.

It should be noted that each of the above examples may be combined with other examples as necessary.

In each of the first, second, and third examples, the getter pump portion may be an evaporable getter pump.

The present disclosure is applicable to turbomolecular pumps, for example.

The invention claimed is:

1. A turbomolecular pump including a rotor portion and a stator portion in a casing, the turbomolecular pump comprising:

a getter pump portion placed in the stator portion;

a heater portion configured to perform at least one of activation and regeneration of a gas absorbing substance of the getter pump portion; and a temperature sensor and a controller for performing temperature control of the gas absorbing substance, wherein the controller is configured to perform temperature control of the gas absorbing substance on the basis of an output signal of the temperature sensor, the stator portion includes stator blades in multiple stages and stator blade spacers in multiple stages positioning the stator blades in multiple stages, the temperature sensor is placed in at least one stator blade spacer of the stator blade spacers in multiple stages, the getter pump portion and the heater portion are placed in the same stator blade spacer as the temperature sensor, the at least one stator blade spacer is located between a first stator blade and a second stator blade of the stator blades in multiple stages, and the temperature sensor, the getter pump portion, and the heater portion are configured to be collectively attached to and detached from the turbomolecular pump by attaching the at least one stator blade spacer to or detaching the same from the turbomolecular pump.

2. The turbomolecular pump according to claim 1, wherein the controller is configured to determine a conducting current of the heater portion and perform constant resistance control based on the conducting current to perform temperature control of the gas absorbing substance.

3. The turbomolecular pump according to claim 1, further comprising a thermal resistance increasing means configured to increase a thermal resistance between a first member in which the getter pump portion is placed and a second member adjacent to the first member, as compared to an instance where the first member is in planar contact with the second member.

4. The turbomolecular pump according to claim 1, wherein:

the rotor portion includes rotor blades in multiple stages; and the getter pump portion is placed closer to an outlet port than the rotor blade in a first stage of the rotor blades in multiple stages.

5. The turbomolecular pump according to claim 1, wherein:

the casing includes an external connection portion that electrically connects the heater portion and an external circuit.

* * * * *